US006155214A

United States Patent [19]

Manthey

[11] Patent Number: 6,155,214

[45] Date of Patent: Dec. 5, 2000

[54] AXIAL PISTON ROTARY ENGINES

[75] Inventor: Steven Charles Manthey, Currimbin Valley, Australia

[73] Assignee: Advanced Engine Technology Pty LTD, Burleigh Gardens, Australia

[21] Appl. No.: 09/242,163

[22] PCT Filed: Aug. 11, 1997

[86] PCT No.: PCT/AU97/00506

§ 371 Date: Feb. 9, 1999

§ 102(e) Date: Feb. 9, 1999

[87] PCT Pub. No.: WO98/06932

PCT Pub. Date: Feb. 19, 1998

[30] Foreign Application Priority Data

Aug. 9, 1996 [AU] Australia ..... PO1573

[51] Int. Cl.[7] ..... F02B 75/26

[52] U.S. Cl. ..... 123/43 AA

[58] Field of Search ..... 123/43 AA; 91/499

[56] References Cited

U.S. PATENT DOCUMENTS 4,213,427 7/1980 Di Stefano ..... 123/43 AA 4,250,843 2/1981 Chang ..... 123/43 AA 5,813,372 9/1998 Manthey ..... 123/43 AA

*Primary Examiner*—Michael Koczo

*Attorney, Agent, or Firm*—Abelman, Frayne & Schwab

[57] ABSTRACT

A rotary internal combustion engine (200) of the type having a rotor assembly (216) supported in a housing (210) for rotation about a longitudinal axis (217), the housing having two spaced apart end plates (212, 213) and the axis being the axis of rotation of an output shaft (218) operatively connected at one end to the rotor assembly, the other end being free and passing through an aperture in one of the end plates, the rotor assembly including a plurality of pistons (231 to 238) mounted for reciprocating movement in respective cylinders (228) arranged in spaced relation around the longitudinal axis, and cam follower means (254) operatively connected to each piston and adapted to coact with undulating cam track means (225) supported around the axis of rotation and between the end plates, characterized in that the undulating cam track means includes an annular track mounted to a support stem or shaft (219) disposed substantially centrally thereof and extending in the direction of the longitudinal axis, the support stem or shaft being supported at one end by the other of the end plates (213) and the axis of the annular cam track means being the axis of rotation of the rotor assembly.

21 Claims, 6 Drawing Sheets

AXIAL PISTON ROTARY ENGINES

TECHNICAL FIELD OF THE INVENTION

THIS INVENTION relates to improvements in axial piston rotary engines, and it has particular but not exclusive application to improvements in or modifications to the type of engine described in broad principles in U.S. Pat. No. 5,813,372.

BACKGROUND ART

Very useful forms of axial piston rotary engines were described and illustrated in U.S. Pat. No. 5,813,372, as apparent especially from the assembly drawing of FIG. 11 thereof, and it is to be understood that all the disclosures of that specification are to be deemed part of the disclosure herein to the extent that the same may be pertinent and/or desirable. In such engines a plurality of pistons are mounted in cylinders as part of a rotor assembly, the pistons cooperating with a cam track to cause rotation of the rotor assembly upon combustion of fuel in the cylinder in a manner typical of piston type internal combustion engines. In this specification, the terms "top end" and "bottom end" are used to refer to the combustion end and drive end of the engine as will be understood by those familiar with piston type internal combustion engines.

It is an object of the invention to provide an axial piston rotary engine of the general type described in the said PCT application in which the thrust on the inlet and/or exhaust port seals is reduced.

It is another object of the invention to provide an axial piston rotary engine of the general type described in the said PCT application in which the bottom end of the engine is sealed from the top end so that lubricant required for the cam track, cam follower, cylinder walls and other bottom end components is prevented or at least substantially prevented from entering the combustion chamber via the inlet ports.

It has been known for a considerable period that timing of opening and closing of inlet and exhaust ports has a significant effect on the operation of internal combustion engines and that the efficiency of internal combustion engines can be increased by varying the timing particularly the timing of opening of the inlet ports in operation. It is thus an object of the present invention to provide an axial piston rotary engine of the general type described in the said PCT application which lends itself to variable inlet timing.

It is another object of the invention to provide an axial piston rotary engine which lends itself to variable length piston stroke for varying the compression ratio whereby different fuels can be used effectively.

DISCLOSURE OF THE INVENTION

With the foregoing and other objects in view, this invention in one aspect resides broadly in a rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to and for conveying exhaust gases from the operative ends of the cylinders whereby cyclical combustion of said fuel in said cylinders may impart reciprocation to said pistons with resultant thrust against said cam track means so as to cause rotation of said rotor assembly and output shaft; characterised in that said undulating cam track means includes an annular track mounted to a support stem or shaft disposed substantially centrally thereof and extending in the direction of said longitudinal axis, said support stem or shaft being supported at one end by the other of said end plates and the axis of said annular cam track means being the axis of rotation of said rotor assembly.

In another aspect the invention resides broadly in a rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to and for conveying exhaust gases from the operative ends of the cylinders whereby cyclical combustion of said fuel in said cylinders may impart reciprocation to said pistons with resultant thrust against said cam track means so as to cause rotation of said rotor assembly and output shaft; characterised in that said plurality of pistons are arranged in two or more sets, each set having two or more pistons arranged in spaced relation around said axis of rotation and interconnected by piston connecting means so that the pistons of each set move in unison, said cam follower means and said undulating cam track means being arranged so that the direction of movement of one set of pistons is generally opposite to the direction of another set of pistons and that said undulating cam track means includes an annular track mounted to a support stem or shaft disposed substantially centrally thereof and extending in the direction of said longitudinal axis, said support stem or shaft being supported at one end by the other of said end plates and the axis of said annular track being the axis of rotation of said rotor assembly.

In yet another aspect the invention resides broadly in a rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to and for conveying exhaust gases from the operative ends of the cylinders whereby cyclical combustion of said fuel in said cylinders may impart reciprocation to said pistons with resultant thrust against said cam track means so as to cause rotation of said rotor assembly and output shaft; characterised in that said plurality of pistons are arranged in two or more sets, each set having two or more pistons arranged in spaced relation around said axis of rotation and interconnected by piston connecting means so that the pistons of each set move in unison, said cam follower means and said undulating cam track means being arranged so that the direction of movement of one set of pistons is generally opposite to the direction of another set of pistons and that each said piston connecting means includes a ring extending about said support stem or shaft and said ring connecting one set of pistons is reciprocable within a ring connecting another set of pistons.

Preferably, said cylinders are provided in a cylinder block and said support stem or shaft is coaxial with said output shaft and rotatably supports said cylinder block. It is also preferred that said output shaft be operatively connected to said cylinder block by an output plate assembly, said cylinder block and said output plate assembly together defining a chamber of generally circular cross section about said longitudinal axis and said cam track means and said cam follower means being housed within said chamber. Preferably, said support stem or shaft is supported at its other end (the end within said chamber) by said output shaft or said output plate assembly. It will be appreciated that in such form of the invention, end thrust will be substantially reduced if not eliminated. Preferably, said cylinder block is sealably supported by said support stem or shaft and said output plate assembly is sealably connected to said cylinder block, such sealing allowing oil or other lubricant to be retained in said chamber for lubricating the cam track means and cam track follower means, cylinder walls and other bottom end components as will be understood more clearly from the description of the drawings with no significant escape of lubricant to the operative ends of the cylinders (or in other words the combustion chambers).

Preferably, said cam track means is pivotably supported by said other end plate whereby, it may be pivoted or rotated to vary the angular position of the cam track means relative to said other end plate. Typically, the means for conveying combustible fuel to and/or exhaust gases from the operative ends of the cylinders will include ports provided in said other end plate and it will be appreciated that angular movement of the cam track means will vary the inlet and/or exhaust timing. Moreover, in embodiments where face sealing means are used to seal the cylinder inlet/exhaust port as will be understood from the embodiments illustrated in the drawings, the reduction in end thrust previously mentioned will reduce loads on such sealing means thereby allowing improved sealing. Additionally, it is preferred that said undulating cam track means be movable towards and away from said other end plate in the direction of said longitudinal axis. Suitably, such movement allows the piston stroke to be varied thereby varying the compression ratio of the engine. Thus provided the engine includes suitable means for supplying fuel to the cylinders, different fuels can be used as desired.

As previously described, the plurality of pistons according to the second aspect of the invention are arranged in two or more sets, each set having two or more pistons arranged in spaced relation around said axis of rotation and interconnected by piston connecting means so that the pistons of each set move in unison, said cam follower means and said undulating cam track means being arranged so that the direction of movement of one set of pistons is generally opposite to the direction of another set of pistons. In a preferred form of the invention there are two sets of pistons arranged so that one set generally moves in the opposite direction to movement of the other set, although there may be overlapping at the ends of the stroke when both sets move momentarily in the same direction. Furthermore, it is preferred that each set include four, six or eight pistons arranged so that alternate pistons are on the power stroke while the other pistons are on the intake (or induction) stroke. It is also preferred that the connecting means of each set of pistons be a continuous ring extending about said support stem or shaft, with one ring arranged to move reciprocably within the other ring. Each such ring should be of sufficient strength to maintain all pistons of the set moving in unison. Whilst it is possible for one set of pistons to be disposed at a greater radius from said longitudinal axis than the other set of pistons and to coact with different cam track means, it is preferred that each set of pistons be arranged equidistant from the longitudinal axis whereby all pistons may coact with the same cam track means. In other forms of the invention where more than two sets of pistons are utilised, it is preferred that they be arranged in pairs with each pair coacting with the same cam track means.

While it will be understood that torque could be transferred from the pistons directly to the cylinder walls, it is preferred that the engine include torque transfer means for transferring torque from each piston to said output shaft, said torque transfer means being such that the pistons are prevented from "slapping" in their respective cylinders or rubbing on the cylinder walls, thereby reducing wear. Moreover, it is preferred that the torque transfer means be effective to maintain the pistons centrally of their respective cylinders. In a preferred form, the torque transfer means transfers torque from the piston connecting means directly to the cylinder block which in turn is fixed to the output plate assembly. In one embodiment in which the piston connecting means is a continuous ring, the torque transfer means includes a ball rotatably captured partly in a recess provided in said ring and partly in a recess provided in said cylinder block and or said output plate assembly. However, in other embodiments, the torque transfer means includes a linear guide shaft extending between the cylinder block and the output plate assembly and secured therein and a linear bearing assembly slidably mounted on said linear guide shaft and secured to the ring.

In order that this invention may be more readily understood and put into practical effect, reference will now be made to the accompanying drawings which illustrate preferred embodiments of the invention and are meant by way of illustration and example only, and are not to be construed as in any way limiting the invention disclosed and claimed herein, whereupon the aforementioned and other objects and advantages of the present invention will become more apparent to those of ordinary skill in the art.

DETAILED DESCRIPTION OF THE DRAWINGS

Figure 1:
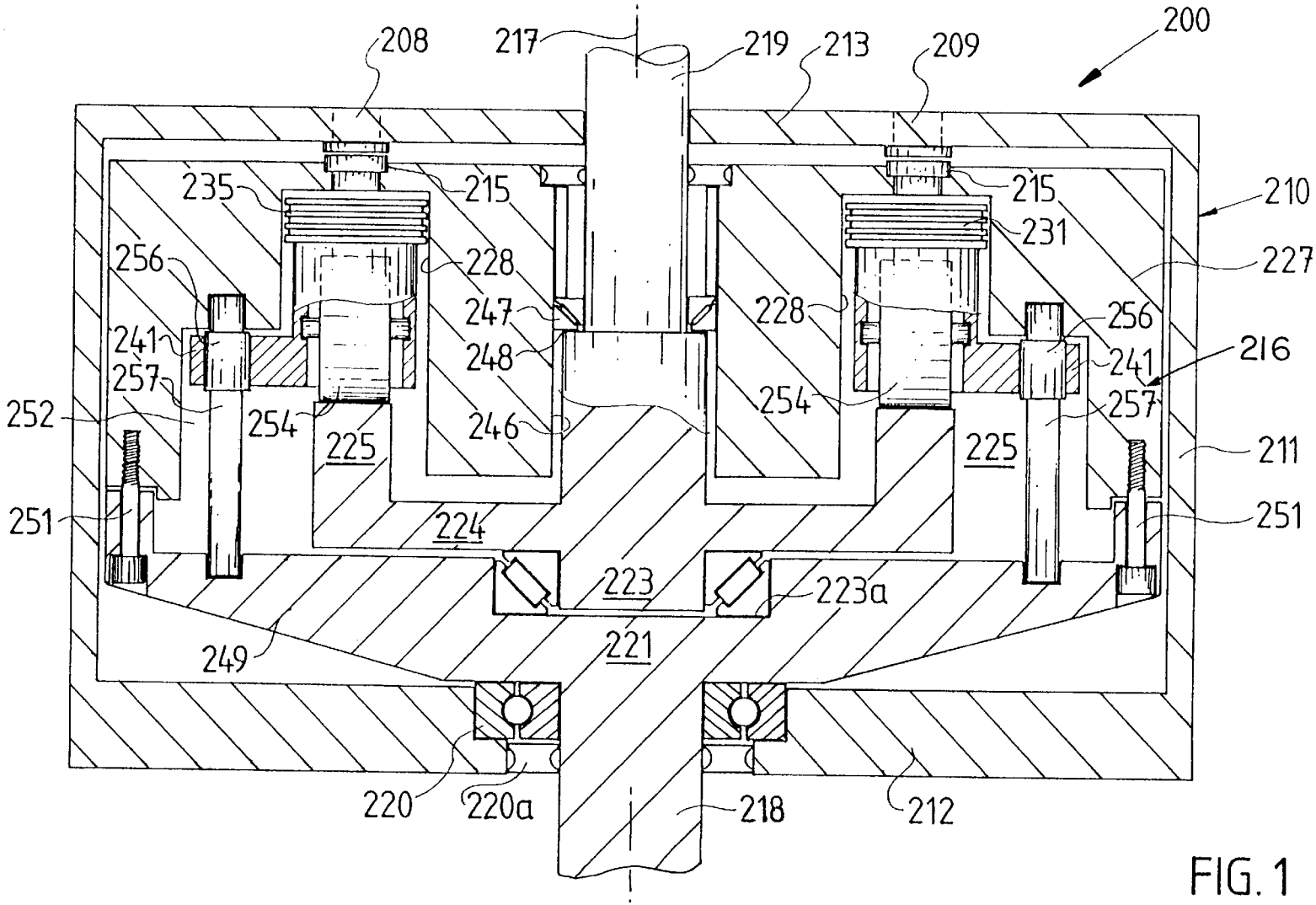
FIG. 1 shows diagrammatically or schematically in diametric cross section or elevation an engine according to the invention with parts omitted for simplification purposes.

The engine 200 illustrated in FIG. 1 includes a housing indicated generally at 210 comprising a cylindrical casing 211 sealably connected to and between spaced apart circular end plates being an output or drive end plate 212 and an induction/exhaust end plate 213, the plate 213 having inlet ports 206 and 207 (both not shown) and exhaust ports 208 and 209 for combustion gas entry and exhaust, as well as suitable spark plug or glow plug provisions (not shown).

A rotor assembly 216 is mounted within the housing 210 for rotation about a longitudinal axis 217 passing generally centrally through the casing and the two end plates, the rotor assembly being supported in the housing by coaxial output shaft 218 and cam track support shaft 219, the free ends of which extend through the drive end plate 212 and the induction end plate 213 respectively as will be described in more detail later, the output shaft being mounted in a bearing 220 and seal 220*a* fitted to the drive end plate. The non-free or inner ends 221 and 222 of the output shaft and cam track support shaft respectively are arranged in almost end abutting relation with the cam track support shaft being rotatably supported by the output shaft. For this purpose a bearing 223 is mounted in a recess 223*a* formed in the end of the output shaft. In this embodiment, the cam track support shaft is shown as being press-fitted to the induction end plate and keyed thereto to prevent relative rotation. However, if longitudinal or pivotable movement is required for changing the compression ratio or varying the inlet timing as will be more easily understood later, a suitable mounting block may be fitted to the external face of the induction end plate. In the embodiment shown in FIG. 5, the cam track support shaft has a spline 325 thereon which secures it to a boss 325*a* which in turn is bolted to the induction end plate. Additionally, it will be seen that the recess 223*a* is replaced by a recess 323*a* provided in the cam track support shaft 319 and the output shaft has a stub shaft or spigot 318*a* which is rotatably mounted in a bearing 323 secured in the recess. Near to its inner end a disc-like portion 224 is integrally formed with the cam track shaft and extends radially therefrom having at its periphery an undulating cam track 225 being of generally sinusoidal form in the direction of the longitudinal axis, the purpose of which will become more apparent later.

The rotor assembly includes a cylinder block 227 having eight equi-spaced cylinders 228 provided therein and being on the same radius from the longitudinal axis 217. Intake and exhaust gases enter and exit the cylinders via a cylinder port 215 which moves into and out of alignment with the inlet ports 206 and 207 and the exhaust ports 208 and 209. The manner in which sealing is maintained between the cylinder port 215 and the induction/exhaust end plate is the same as that described in U.S. Pat. No. 5,813,372.

Figure 2:
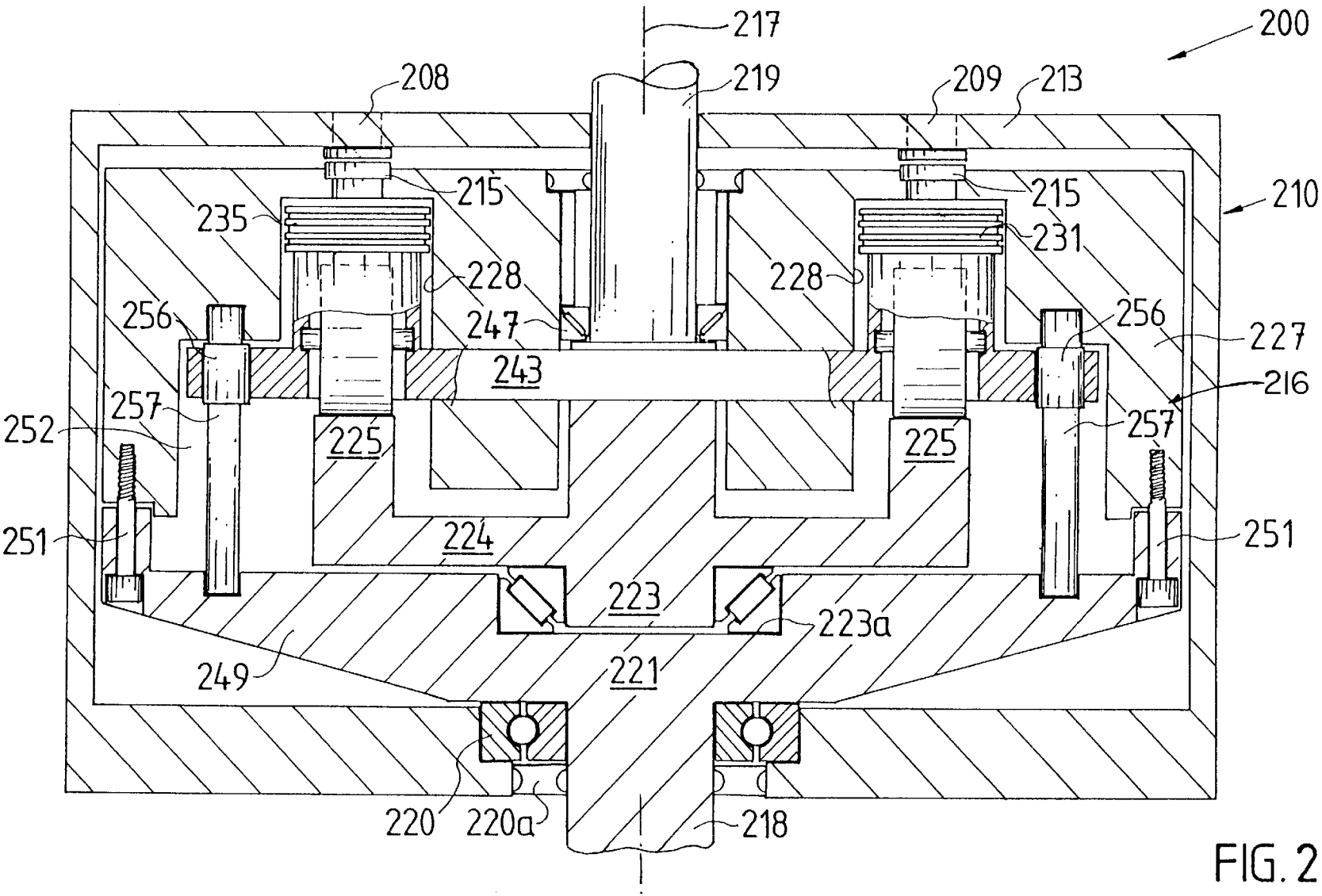
FIG. 2 shows diagrammatically or schematically in diametric cross section or elevation another engine according to the invention with parts omitted for simplification purposes.
Figure 3:
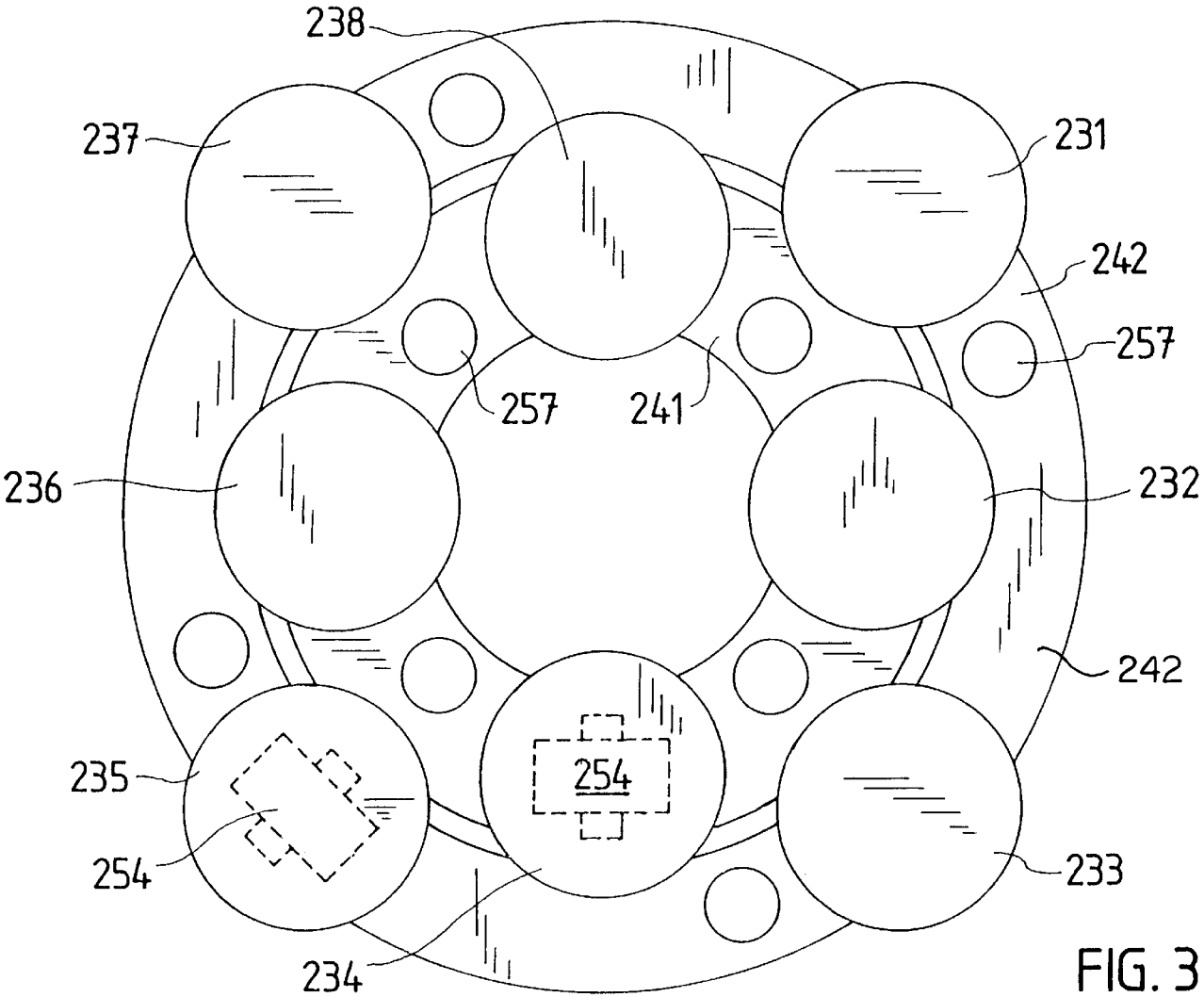
FIG. 3 is a diagrammatic plan view of an engine of the general type shown in FIG. 1 showing how two annular connecting ring assemblies may be used to carry two sets of pistons coacting with separate cam tracks according to the invention, the plan view illustrating diagrammatically the torque transfer means described in relation to FIGS. 1 and 2.
Figure 4:
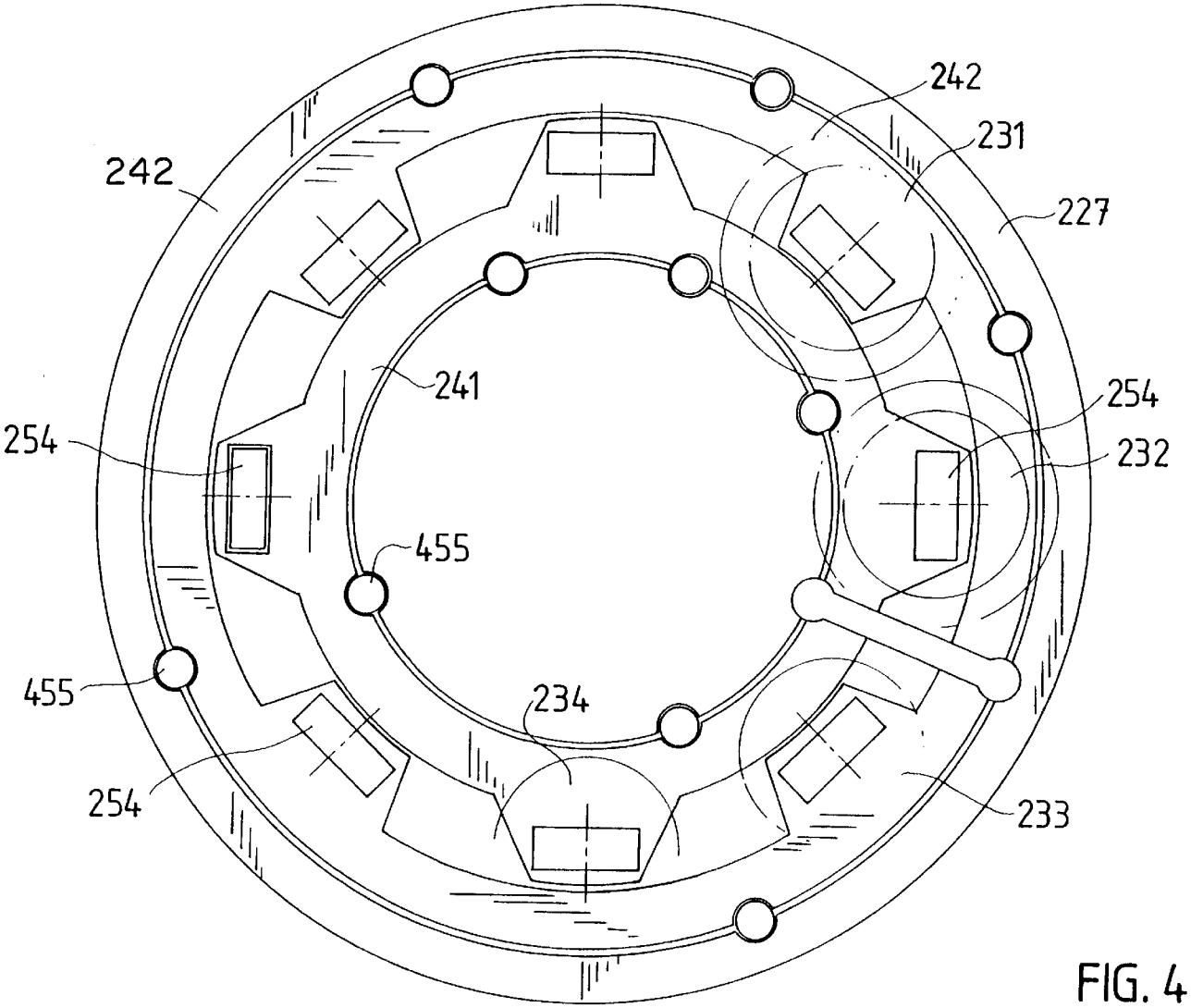
FIG. 4 is a diagrammatic plan view of an engine of the general type shown in FIG. 1 showing how two annular connecting ring assemblies may be used to carry two sets of pistons coacting with the same cam track according to the invention, the plan view illustrating diagrammatically the torque transfer means described in relation to FIG. 6.

Pistons 231 to 238 are arranged for reciprocating movement in respective ones of the cylinders 228 parallel to the longitudinal axis, four of the pistons being mounted on an inner piston connecting ring assembly 241 and the alternate four pistons being mounted on an outer piston connecting ring assembly 242 as shown diagrammatically in FIGS. 3 and 4. It will be understood that the use of rings for connecting the pistons of each set allows for one or two sets of pistons to coact with one cam track and further sets to coact with one or more cam tracks disposed radially outwardly of the other track as shown diagrammatically in FIG. 3. The embodiment illustrated in FIG. 2 is the same as that of FIG. 1 except that the pistons are mounted on respective star shaped mounting plates 243 and 244 (not shown) respectively.

Figure 5:
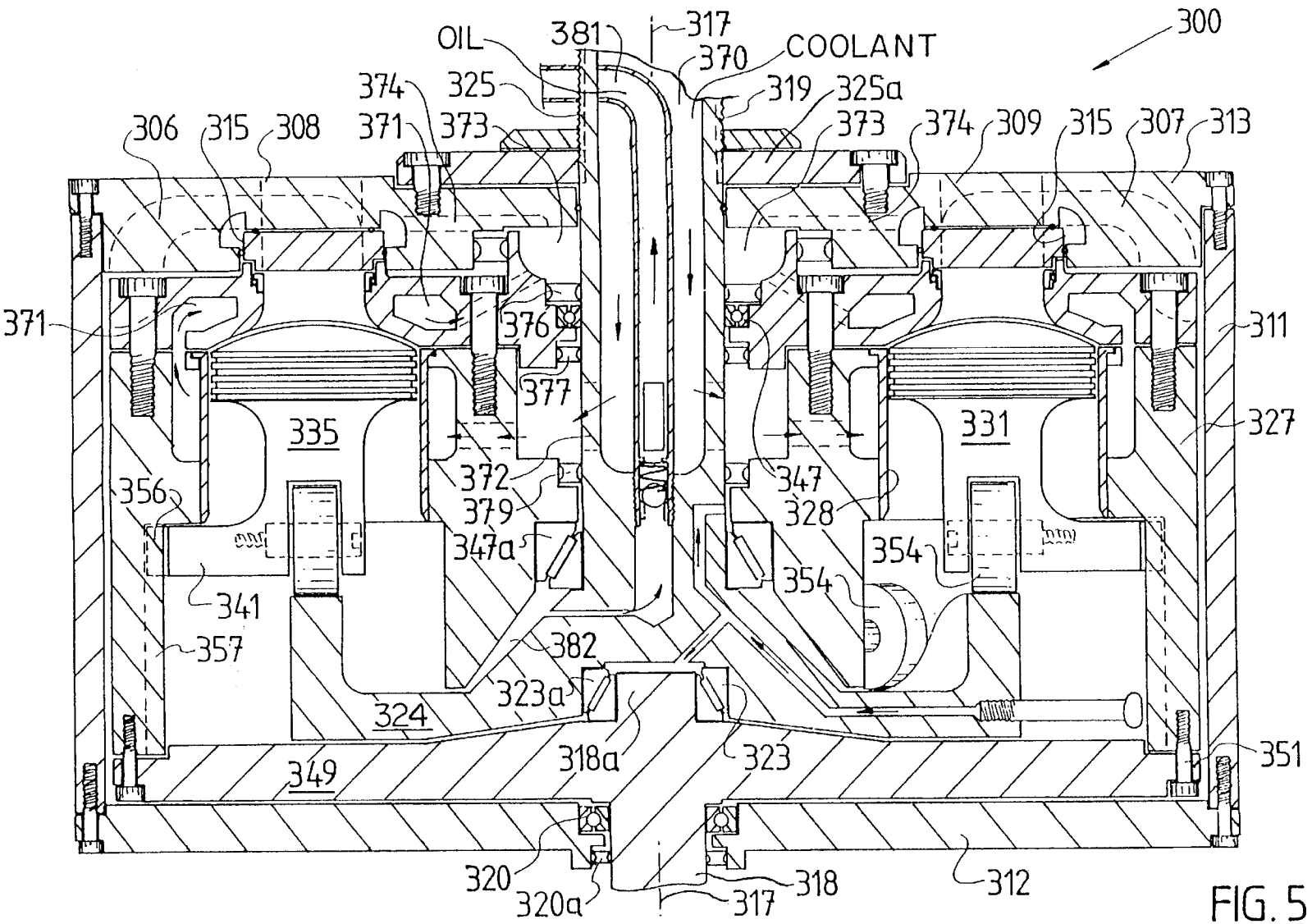
FIG. 5 is a sectional view of an engine according to the invention showing more detail of various components.
Figure 6:
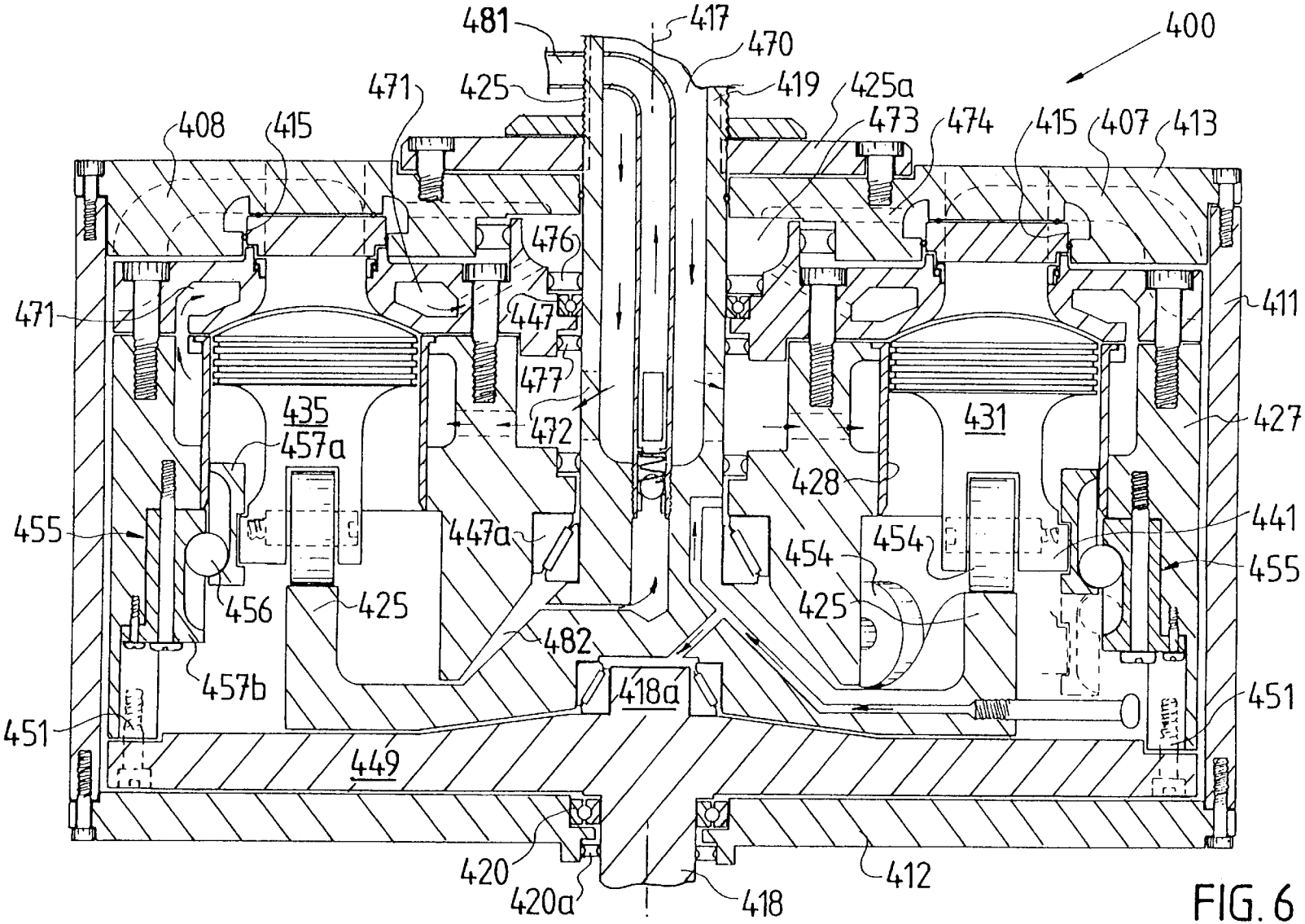
FIG. 6 is a sectional view of another engine according to the invention utilizing alternative torque transfer means to that of the engine of FIG. 5.

A bore 246 extends through the cylinder block coaxial with the longitudinal axis 217 for receiving therethrough the cam track support shaft 219, the rotor assembly being supported via the cylinder block for rotation about the cam track support shaft. For this purpose a bearing 247 is fitted to the bore 246 and is seated on a shoulder 248 formed on the cam track support shaft. In the embodiments of FIGS. 5 and 6, an additional bearing 347*a* is provided in the bore adjacent the disc-like portion 324. The output shaft 218 is connected to the rotor assembly by a disc-like output plate assembly 249 which is bolted to the drive end of the cylinder block about its periphery by bolts 251, the drive end being the "bottom end", the output plate assembly and the cylinder block together defining a chamber 252, with the eight cylinders opening at their non-operative or "bottom" ends into the chamber. It will be seen that the cam track support shaft and the output shaft cooperate via the bearing 223 to form a central support shaft for the rotor assembly, the cam track support shaft being more or less fixed and the output shaft rotating with the rotor assembly.

Each piston is connected at its bottom end to a roller 254 which is in continuous rolling contact with the cam track 225 whereby reciprocation of the pistons 231 to 238, due to cyclical combustion of fuel in the cylinders and coacting of the rollers with the cam track, will cause the rotor assembly to rotate as will be well understood from the said PCT application. Torque is transferred from the pistons and piston ring assemblies to the cylinder block and output shaft by a number of linear bearings 256 which slide on linear guide pins 257 spaced around the piston connecting rings.

It will be seen that the piston connecting ring assemblies 241 and 242, the rollers 254, the cam track 225, the linear bearings and linear guide pins and the lower parts of the pistons are all housed within the chamber 252 so that oil can be contained therein to lubricate all moving parts requiring oil lubrication.

The embodiments illustrated in FIGS. 5 and 6 are similar to those of FIGS. 1, 2 and 3 and accordingly corresponding components are numbered by the same numbers but commencing with a 3 or a 4 rather than a 2. Both of these embodiments incorporate different means from that of FIGS. 1, 2 and 3 of transferring torque from the pistons to the output shaft. In FIG. 5 it can be seen that the piston connecting ring assemblies 341 and 342 (not shown) have radially extending spline portions 356 which are slidably mounted in guide channels 357 provided in the cylinder block parallel to the longitudinal axis 317. The means of transferring torque shown in FIG. 6 is believed to be particularly effective and includes a plurality of captured ball assemblies 455 each comprising a ball 456 and two ball track halves 457*a* and 457*b* arranged around the periphery of each piston ring assembly, there being typically one assembly per piston. Each track half has a half cylindrical track formed therein of a diameter fractionally greater than the ball, so that the two halves together form a closed cylindrical track adapted to contain the ball therein, the ball being allowed to roll along the track. Track half 457*a* is fixed to the piston ring assembly and the other track half 457*b* is fixed to the cylinder block for rolling movement of the ball within the track halves parallel to the longitudinal axis. It will be understood that each track half 457*a* reciprocates with its respective connecting ring assembly thereby being displaced longitudinally relative to its associated track half 457*b*, the ball effectively transferring torque from one track half to the other track half.

As illustrated in FIG. 5 (and similarly in FIG. 6), coolant is supplied to the rotor assembly for passage through a water jacket 371 within the cylinder block via a central bore 370 provided in the cam track support shaft 319 and apertures 372 provided therein, then exiting the top end of the cylinder block 327 adjacent the cam track support shaft through an exit passage 373 which seals against an annular outlet passage 374 provided in the inner face of the induction end plate. Coolant then exits the induction end via an aperture (not shown) for cooling in a radiator in the normal manner. Seals 376 and 377 and 379 are provided in recesses in the central bore 346 of the cylinder block on the opposite sides of the bearing 347 and similarly a seal 378 is provided on the "top" side of bearing 323 to contain coolant in the water jacket.

Lubricant is supplied to the bottom end components via a supply conduit 381 passing through the central bore 370 and opening into the chamber 352. Various oil shafts and supply lines are provided in the engine as necessary for example oil shaft 382 for effective lubrication as will be understood by those skilled in the art. The induction/exhaust end plate 213 provides a mounting for external items such as spark plugs, fuel injectors, exhaust outlets and lines, fittings for supply of coolant, pick up for electronic ignition, and similar items as will be understood from the said PCT application.

The engines described herein operate in a manner similar to that described in U.S. Pat. No. 5,813,372, the main difference being that the cam track means is supported by a central shaft which results in advantages as previously mentioned.

The invention described herein may be subject to many further variations and modifications as will be readily apparent to persons skilled in the art without departing from the scope and ambit of the invention, as defined by the appended claims.

What is claimed is:

1. A rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to, and for conveying exhaust gases from the operative ends of the cylinders whereby cyclical combustion of said fuel in said cylinders imparts reciprocation to said pistons with resultant thrust against said cam track means so as to cause rotation of said rotor assembly and output shaft; characterised in that said undulating cam track means includes an annular track mounted to a support stem or shaft disposed substantially centrally thereof and extending in the direction of said longitudinal axis, said support stem or shaft being supported at one end by the other of said end plates and the axis of said annular cam track means being the axis of rotation of said rotor assembly.

2. A rotary internal combustion engine according to claim 1, wherein said cylinders are provided in a cylinder block and said support stem or shaft is coaxial with said output shaft and rotatably supports said cylinder block.

3. A rotary internal combustion engine according to claim 2, wherein said output shaft is operatively connected to said cylinder block by an output plate assembly, said cylinder block and said output plate assembly together defining a chamber about said support stem or shaft and said cam track means, said cam follower means being housed within said chamber.

4. A rotary internal combustion engine according to claim 3, wherein said cylinder block is sealably supported by said support stem or shaft and said output plate assembly is sealably connected to said cylinder block.

5. A rotary internal combustion engine according to claim 2, wherein said support stem or shaft is supported at its other end by said output shaft or said output plate assembly.

6. A rotary internal combustion engine according to claim 1, wherein said cam track means is supported by said other end plate for pivoting movement about said longitudinal axis.

7. A rotary internal combustion engine according to claim 1, wherein said undulating cam track means is movable towards and away from said other end plate.

8. A rotary internal combustion engine according to claim 7, and including means for moving said cam track means towards and away from said other end plate and/or pivoting said cam track means relative to said other end plate.

9. A rotary internal combustion engine according to claim 2, wherein said other end plate has openings therein provided with port means adapted to register with corresponding movable ports in said cylinder block for admitting fuel to the operative ends of the cylinders, said other end plate being at the induction and exhaust end of the engine and constituting a mounting for fuel injector means, spark plug or equivalent as required for the particular engine and exhaust outlet means.

10. A rotary internal combustion engine according to claim 9 wherein said other end plate has a pair of diametrally opposed spark plugs constituting said spark plug or equivalent means, a pair of diametrally opposed fuel injector assemblies constituting said fuel injector means, and a pair of diametrally opposed exhaust outlets constituting said exhaust outlet means, all said pairs being arranged at spaced intervals to coact with cylinder ports to permit successive intake, compression, power and exhaust functions of the pistons.

11. A rotary internal combustion engine according to claim 9, wherein said support stem or shaft has a bore adapted to provide coolant entry means to said rotor assembly, inlet passages being provided from said bore to said cylinder block.

12. A rotary internal combustion engine according to claim 1, wherein said housing includes a substantially cylindrical casing body connected sealably to and between said two spaced apart end plates.

13. A rotary internal combustion engine according to claim 1, including two sets of pistons arranged equidistant from the longitudinal axis whereby all pistons of said two sets may coact with the same cam track means.

14. A rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to and for conveying exhaust gases from the operative ends of the cylinders whereby cyclical combustion of said fuel in said cylinders may impart reciprocation to said pistons with resultant thrust against said cam track means so as to cause rotation of said rotor assembly and output shaft; characterised in that said plurality of pistons are arranged in two or more sets, each set having two or more pistons arranged in spaced relation around said axis of rotation and interconnected by piston connecting means so that the pistons of each set move in unison, said cam follower means and said undulating cam track means being arranged so that the direction of movement of one set of pistons is generally opposite to the direction of another set of pistons and that said undulating cam track means includes an annular track mounted to a support stem or shaft disposed substantially centrally thereof and extending in the direction of said longitudinal axis, said support stem or shaft being supported at one end by the other of said end plates and the axis of said annular track being the axis of rotation of said rotor assembly.

15. A rotary internal combustion engine according to claim 14, wherein each said piston connecting means includes a ring extending about said support stem or shaft and said ring connecting one set of pistons is reciprocable within the ring connecting another set of pistons.

16. A rotary internal combustion engine according to claim 15, including torque transfer means for transferring torque from the respective ring to said output shaft.

17. A rotary internal combustion engine according to claim 16, wherein said torque transfer means includes a ball rotatably captured partly in a recess associated with the respective ring and partly in a recess associated with said cylinder block and/or said output plate assembly.

18. A rotary internal combustion engine according to claim 16, wherein said torque transfer means includes a linear guide shaft extending between said cylinder block and said output plate assembly and secured therein and a linear bearing assembly slidably mounted on said linear guide shaft and secured to said ring.

19. A rotary internal combustion engine according to claim 15, wherein each cam follower means includes a roller mounted for rotation about an axis at right angles to said longitudinal axis.

20. A rotary internal combustion engine according to claim 19, wherein each roller is in non-captive relation to its cam track means by virtue of the or each cam track means having a single continuous undulating face against which each roller is engageable only at that part of the periphery of each roller which is furthermost from the respective piston.

21. A rotary internal combustion engine of the type having a rotor assembly supported in a housing for rotation about a longitudinal axis, said housing having two spaced apart end plates and said axis being the axis of rotation of an output shaft operatively connected at one end to said rotor assembly, the other end being free and passing through an aperture in one of said end plates, said rotor assembly including a plurality of pistons mounted for reciprocating movement in respective cylinders arranged in spaced relation around said longitudinal axis, and cam follower means operatively connected to each piston and adapted to coact with undulating cam track means supported around said axis of rotation and between said end plates, means being provided for conveying combustible fuel to and for conveying exhaust gases from the operative ends of the cylinders whereby cyclical combustion of said fuel in said cylinders may impart reciprocation to said pistons with resultant thrust against said cam track means so as to cause rotation of said rotor assembly and output shaft; characterised in that said plurality of pistons are arranged in two or more sets, each set having two or more pistons arranged in spaced relation around said axis of rotation and interconnected by piston connecting means so that the pistons of each set move in unison, said cam follower means and said undulating cam track means being arranged so that the direction of movement of one set of pistons is generally opposite to the direction of another set of pistons; characterised in that each said piston connecting means includes a ring extending about said support stem or shaft and said ring connecting one set of pistons is reciprocable within a ring connecting another set of pistons.

* * * * *